US008273223B2

(12) United States Patent
Van Acker et al.

(10) Patent No.: US 8,273,223 B2
(45) Date of Patent: Sep. 25, 2012

(54) HANDLING DEVICE FOR HOODS OF A CELL FOR ELECTROLYTIC ALUMINIUM PRODUCTION

(75) Inventors: Alain Van Acker, Orchies (FR); Ludovic Demeulenaere, Orchies (FR)

(73) Assignee: E.C.L., Ronchin (FR)

( * ) Notice: Subject to any disclaimer, the term of this patent is extended or adjusted under 35 U.S.C. 154(b) by 1496 days.

(21) Appl. No.: 11/721,385

(22) PCT Filed: Dec. 20, 2005

(86) PCT No.: PCT/FR2005/003193

§ 371 (c)(1), (2), (4) Date: Jun. 11, 2007

(87) PCT Pub. No.: WO2006/067324

PCT Pub. Date: Jun. 29, 2006

(65) Prior Publication Data

US 2009/0238665 A1 Sep. 24, 2009

(30) Foreign Application Priority Data

Dec. 21, 2004 (FR) ..... 04 13644

(51) Int. Cl.
*C25C 7/00* (2006.01)
*C25C 3/06* (2006.01)

(52) U.S. Cl. ..... 204/245; 204/279; 204/286.1; 204/297.01; 204/243.1; 205/389; 205/392; 901/2; 901/14

(58) Field of Classification Search ..... 204/245, 204/279, 286.1, 297.01, 243.1; 205/389, 205/392; 901/2, 14
See application file for complete search history.

(56) References Cited

U.S. PATENT DOCUMENTS

| | | | | |
|---|---|---|---|---|
| 3,351,546 | A * | 11/1967 | Chambran et al. | 204/244 |
| 3,935,090 | A | 1/1976 | Petrusenko | |
| 3,948,749 | A | 4/1976 | Sargent | |
| 4,202,753 | A | 5/1980 | Bradford | |
| 4,369,872 | A * | 1/1983 | Sticht | 198/345.3 |
| 4,855,031 | A | 8/1989 | Zannini | |
| 5,435,897 | A | 7/1995 | Zannini | |
| 5,757,419 | A * | 5/1998 | Qureshi et al. | 348/82 |
| 2007/0009076 | A1 * | 1/2007 | Hunt et al. | 376/260 |

* cited by examiner

*Primary Examiner* — Harry D Wilkins, III
*Assistant Examiner* — Zulmariam Mendez
(74) *Attorney, Agent, or Firm* — Dennison, Schultz & MacDonald

(57) ABSTRACT

A handling device for hoods of an aluminum production cell by fused bath electrolysis, including a positioning device and a hood-gripping device. The positioning device includes a vertical guide device, a mobile support mounted on the guide device so that it can be moved in at least a vertical direction during use, an articulated arm, a first framework mounted on the articulated arm so that it can pivot about a first rotation axis A substantially horizontal during use, a motor to make the first framework pivot about the first rotation axis A, a second framework mounted on the first framework so that it can be moved along the first translation axis B that is substantially horizontal during use, and means of displacing the second framework along the first translation axis B. The hood-gripping system is fixed to the second framework and includes a set of gripping devices designed to grip a set of hoods at a number of fixing points.

27 Claims, 12 Drawing Sheets

HANDLING DEVICE FOR HOODS OF A CELL FOR ELECTROLYTIC ALUMINIUM PRODUCTION

FIELD OF THE INVENTION

This invention relates to aluminium production by fused bath electrolysis using the Hall-Héroult process. It more particularly relates to work done on electrolytic cells such as anode changes, and tending assemblies designed to perform this work.

STATE OF THE ART

Aluminium is produced industrially by fused bath electrolysis in electrolytic cells using the Hall-Héroult process. The French patent application No. FR 2 806 742 (corresponding to U.S. Pat. No. 6,409,894) describes the installations in an electrolysis plant intended for production of aluminium. The outline of electrolytic cells on the ground is globally rectangular in shape. In the following, we will denote the direction of the long side of a cell as X, the direction of the small side as Y, and the vertical direction as Z.

Electrolysis reactions, secondary reactions and high operating temperatures lead to the production of gas effluents that in particular contain carbon dioxide and fluoride products. Release of these effluents into the atmosphere is severely controlled and regulated, not only concerning the ambient atmosphere in the electrolysis room to control work conditions of personnel working close to the cells, but also for atmospheric pollution. Pollution regulations in several countries impose limits on quantities of effluents released into the atmosphere.

Nowadays, solutions exist for reliably and satisfactorily extracting, retrieving and treating these effluents. One widely used solution is to provide electrolytic cells with an effluent collection device. This device covers the electrolytic cells and includes confinement means that particularly include a hooding device, suction means and chemical treatment means for the effluents.

The hooding device includes removable hoods that provide access inside the cell, particularly during replacement of a spent anode by a new anode.

The hoods are removed from the cell and are put back into place manually one by one by an operator on the ground. The operator is thus exposed to risks related to the proximity of the electrolytic cell and the presence of handling tools. In particular, the operator needs to lean towards the cell to pick up and put down the hoods. Since the hoods are supported on fairly small surfaces, incorrect positioning of a hood can result in the hood leaning badly on the cell, causing the operator to lose his balance and risk falling into the pot. Furthermore, removal of the hoods reduces the efficiency of the collection device and exposes the operator to effluents from the cell, which forces him to wear protection masks.

Therefore, the applicant searched for a procedure and means of avoiding these disadvantages.

DESCRIPTION OF THE INVENTION

A purpose of the invention is a handling device for the hoods of a cell for the production of aluminium by fused bath electrolysis, that picks up hoods, moves them and puts them back into place working remotely from the cell, and that can be fully or partly automated.

The hood-handling device of an electrolytic cell according to the invention comprises a positioning device capable of decomposing hood-handling operations into a determined set of basic movements and a system for gripping hoods that gets a firm grip of a determined set of hoods.

In one preferred embodiment of the invention, the hood-handling device is characterised in that it comprises:

- a positioning device that comprises a vertical guide device such as a telescopic mast, a mobile support such as a trolley mounted on the vertical guide device so that it can be moved in at least a vertical direction during use, an articulated arm mounted on the mobile support, a first framework mounted on the articulated arm so that it can pivot about a first rotation axis A substantially horizontal during use, the said articulated arm being at least capable of moving the first framework away from or towards the mobile support, a motor to make the first framework pivot about the said first rotation axis A, a second framework mounted on the first framework so that it can be moved along the first determined translation axis B, that is substantially horizontal during use, and means of displacing the second framework along the said first translation axis B;
- a hood-gripping system fixed to the second framework and including a determined set of gripping devices designed to grip a determined set of hoods at a determined number of attachment points.

According to the invention, the hood-handling operations are broken down into a determined set of basic movements, each of these basic movements being assured by specific components of the device. The vertical guide device and the mobile support are used mainly for vertical movements of the gripping system, the articulated arm is used for movements to bring the gripping system towards or away from the hood, the first framework and the motor associated with it being used to move the gripping system to orient it with respect to the vertical, and the second framework and the displacement means associated with it being used for lateral movements of the gripping system, in other words movements parallel to the long sides of the electrolytic cell. These movements may be slaved.

A firm grip of the hoods by the gripping system at a determined number of points reduces uncontrolled mechanical oscillations of the hoods during handling and thus holds the hoods in a determined position fixed with respect to the said second framework (this position typically being parallel to the said framework).

The device according to the invention is used to satisfactorily handle hoods in the very cluttered environment of the electrolytic cells, with the precision necessary for the mechanization and possible automation of handling operations.

Another purpose of the invention is a tending machine for a series of cells for the production of aluminium by fused bath electrolysis comprising a plurality of hoods, characterised in that it comprises at least one hood-handling device according to the invention. A pot tending machine is used for various operations on electrolytic cells, and particularly for anode changes. It is provided with special purpose tools for these various operations, usually mounted on approximately vertical arms, preferably telescopic, that move said tools between their working zone and a rest position located at a safety elevation. Advantageously, said hood-handling device is fixed to said tending machine by means of the vertical guide device that can thus perform a role identical to the role of telescopic arms of adjacent tools.

Another purpose of the invention is a mobile unit, free to move in the potroom, comprising at least one hood-handling device according to the invention. Advantageously, this mobile unit is provided with a control system for assuring that said positioning device is located in a determined position with respect to the hood or to the plurality of hoods to be handled. Said mobile unit is used to bring the device for handling a hood or a determined set of hoods closer or further away, aiming at a determined position that can be defined by a distance ΔX along the X direction of the long side of the electrolytic cell, a distance ΔY along the Y direction of the small side of the electrolytic cell and a difference in elevation ΔZ between a characteristic point on the handling device, for example a particular point on the mobile support, and a characteristic point on the plurality of hoods to be handled, for example the position of the anode stem for which said plurality of hoods has to be removed so that the anode can be replaced. Said predetermined position represents the initial position of the positioning device before it is put into action, and forms a reference point for subsequent movements imposed on the various elements that make up said handling device.

Said mobile unit may be a self-powered vehicle capable of moving in the potroom. It may also be a tending unit comprising a travelling crane, typically capable of moving along the line of cells, a trolley, typically capable of moving along said travelling crane and a tending machine fixed on the trolley and comprising said handling device. Advantageously, the mobile unit can move in an approximately horizontal plane. Optionally, it may be provided with an actuator that moves said positioning device along the vertical direction, its action being used for pre-positioning in elevation before the mobile support on the vertical guide device is moved. Advantageously, it is also provided with an actuator to place said positioning device such that the translation axis B of the second frame is approximately parallel to the X direction along the long side of the electrolytic cell.

Another purpose of the invention is a method for removing at least one hood of an aluminium production cell by fused bath electrolysis characterised in that:

a) at least one mobile unit according to the invention is used provided with at least one hood-handling device according to the invention;

b) said mobile unit is placed such that said positioning device is in a determined initial position, the translation axis B of the second frame being approximately parallel to the X direction;

c) the articulated arm, the first frame and/or the second frame and optionally the gripping system are manoeuvred, so as to put the gripping devices of the gripping system in a position to grab said hoods;

d) the gripping devices are actuated so as to grip said hoods;

e) the articulated arm, the first frame and/or the second frame and optionally the gripping system are manoeuvred, so as to remove said hoods and transport them as far as a determined storage area.

Advantageously, said articulated arm includes a fixed member rigidly fixed to the mobile support and a mobile member, the first end of which is fixed to the fixed member so as to be capable of pivoting about an axis C approximately parallel to axes A and B, and the second end of which is fixed to the first frame enabling the first frame to pivot about said axis A. In this way, by combining the rotation of the mobile member about the axis C and rotation of the first frame about the axis A, the gripping devices can be forced to follow a globally plane trajectory in a plane approximately perpendicular to the X direction, tending to move said hoods away from the frame of the superstructure on which they normally rest, said trajectory initially being approximately normal to the surface of said hoods. Optionally, a low amplitude oscillation movement along the X direction is imposed on the second frame, which facilitates extraction of the hoods.

Another purpose of the invention is a method for putting at least one hood of an aluminium production cell by fused bath electrolysis into place, characterised in that:

a) at least one mobile unit according to the invention is used provided with at least one hood-handling device according to the invention;

b) said mobile unit is displaced as far as a determined storage area of the hoods and the gripping device is actuated so as to grip said hoods;

c) said mobile unit provided with said hoods is placed such that said positioning device is located in a determined initial position, the translation axis B of the second frame being approximately parallel to the X direction;

c) the articulated arm, the first frame and/or the second frame and optionally the gripping system are manoeuvred so as to put the gripping devices of the gripping system into position to put said hoods down;

d) the gripping devices are actuated so as to release said hoods;

e) the articulated arm, the first frame and/or the second frame and optionally the gripping system are manoeuvred so as to move said positioning device away from said hoods.

Another purpose of the invention is a method of replacing anodes in an electrolytic cell characterised in that it includes a step in which at least one hood located close to said anode is removed following the hood removal method according to the invention, described above, and a step in which said at least one hood is put back into place after said anode has been replaced, using the hood placement procedure according to the invention described in the previous paragraph.

The invention is described in the following in more detail with reference to the attached figures.

Figure 1:
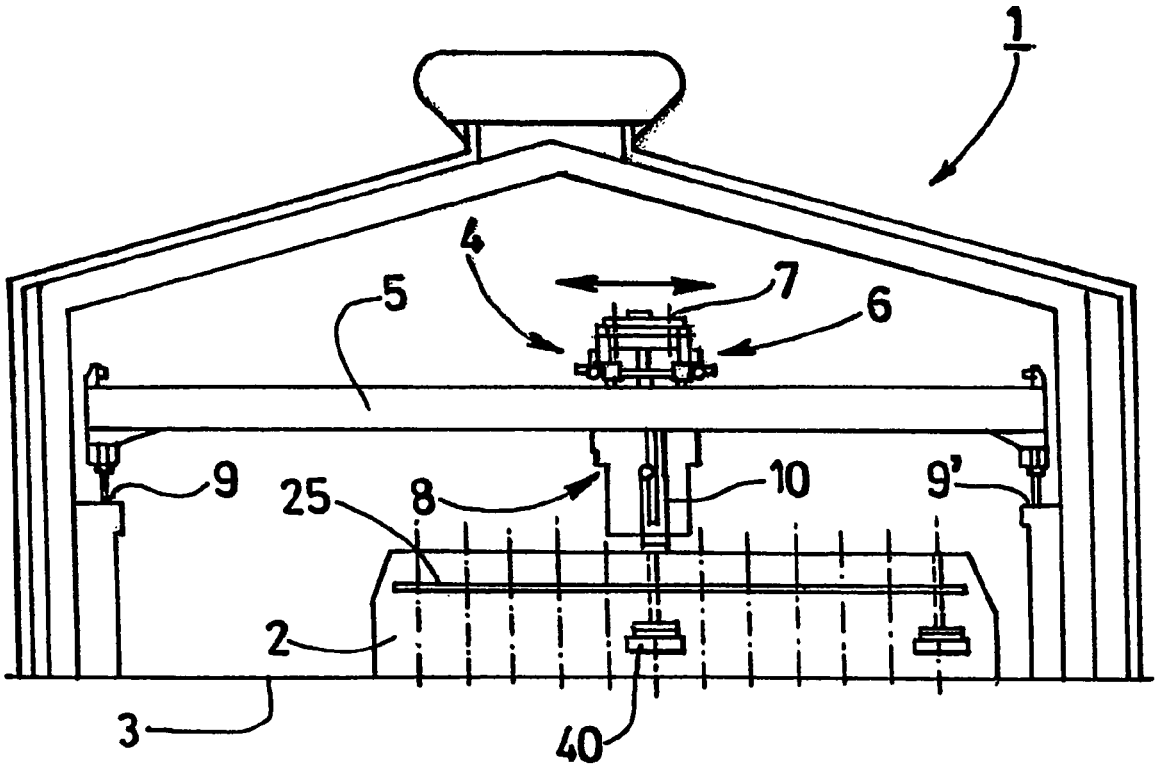
FIG. 1 shows a sectional view of a typical electrolysis room intended for the production of aluminium and including a tending assembly represented diagrammatically.

Electrolysis plants intended for production of aluminium comprise a liquid aluminium production zone that comprises one or several electrolysis rooms (1). As shown in FIG. 1, each electrolysis room (1) comprises electrolytic cells (2) and at least one tending assembly (4). Tending assemblies are often called Pot Tending Assemblies or Pot Tending Machines.

Figure 2:
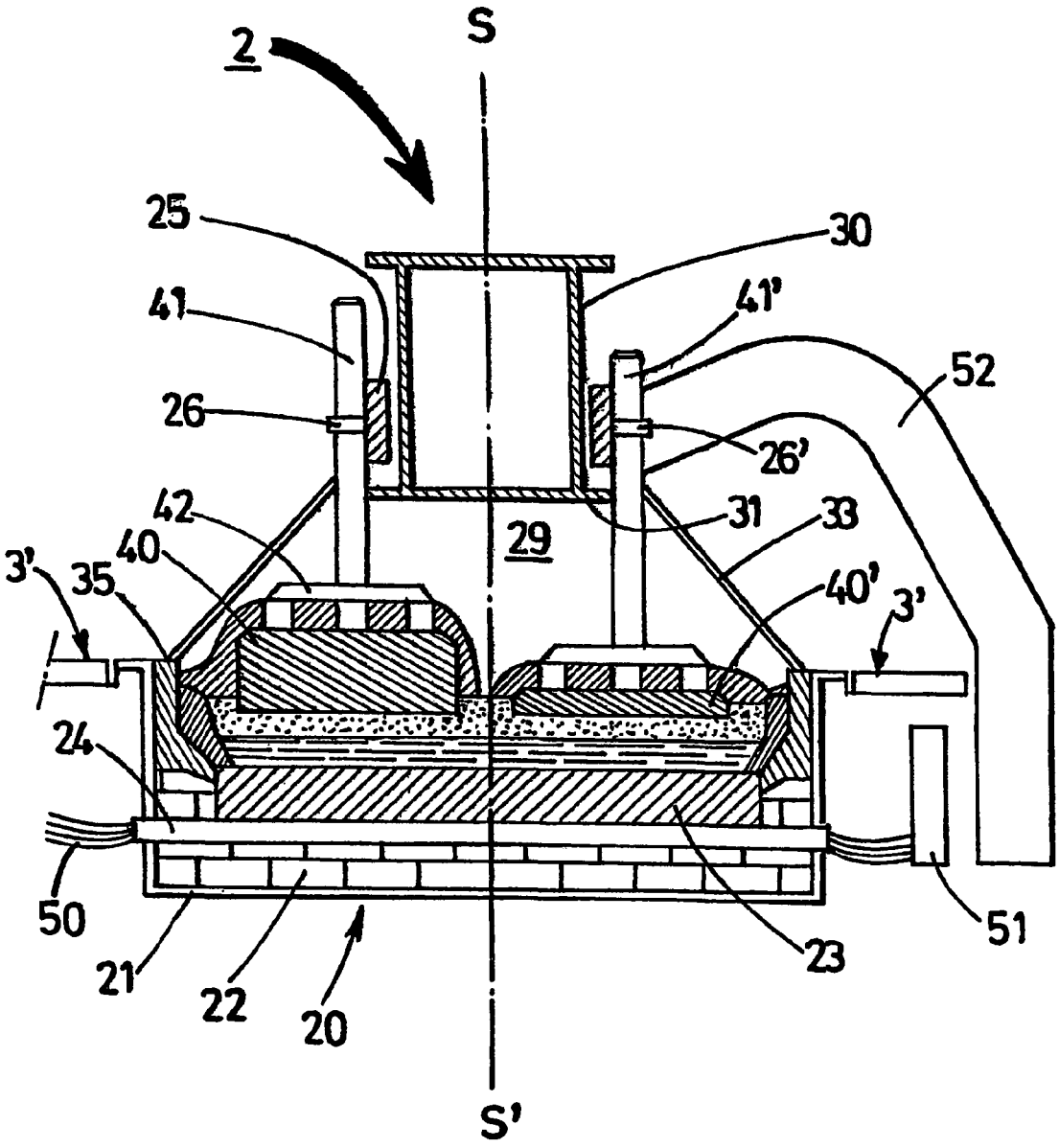
FIG. 2 shows a cross-section of a typical electrolytic cell intended for production of aluminium.

As shown in FIG. 2, each electrolytic cell (2) comprises a pot (20), a support structure (30) called a superstructure, and a plurality of anodes (40, 40'). The pot (20) includes a steel shell (21), an inner lining (22) generally formed by blocks made of refractory materials, and a cathode assembly (23, 24) that comprises blocks made of a carbonaceous material, called "cathode blocks" (23), and steel connection bars (24)

to which electrical conductors (50, 51, 52) are fixed used to transfer the electrolysis current. Each anode is provided with a steel stem (41, 41') that is typically fixed to the anode through a multipod (42). The anodes (40, 40') are fixed removably to a mobile metallic beam (25) called the "anode beam", through a removable connector (26, 261). The anode beam (25) is carried by the superstructure (30) and fixed to electrical conductors (52) called "positive risers", that carry the electrolysis current.

The electrolytic cells (2) are normally arranged in rows or lines, each row or line typically comprising more than a hundred cells, and electrically connected in series using connecting conductors (50, 51, 52). The cells (2) are arranged so as to leave a circulation aisle (3) along the length of the electrolysis room (1), and an access path (3') between the electrolytic cells.

Figure 3:
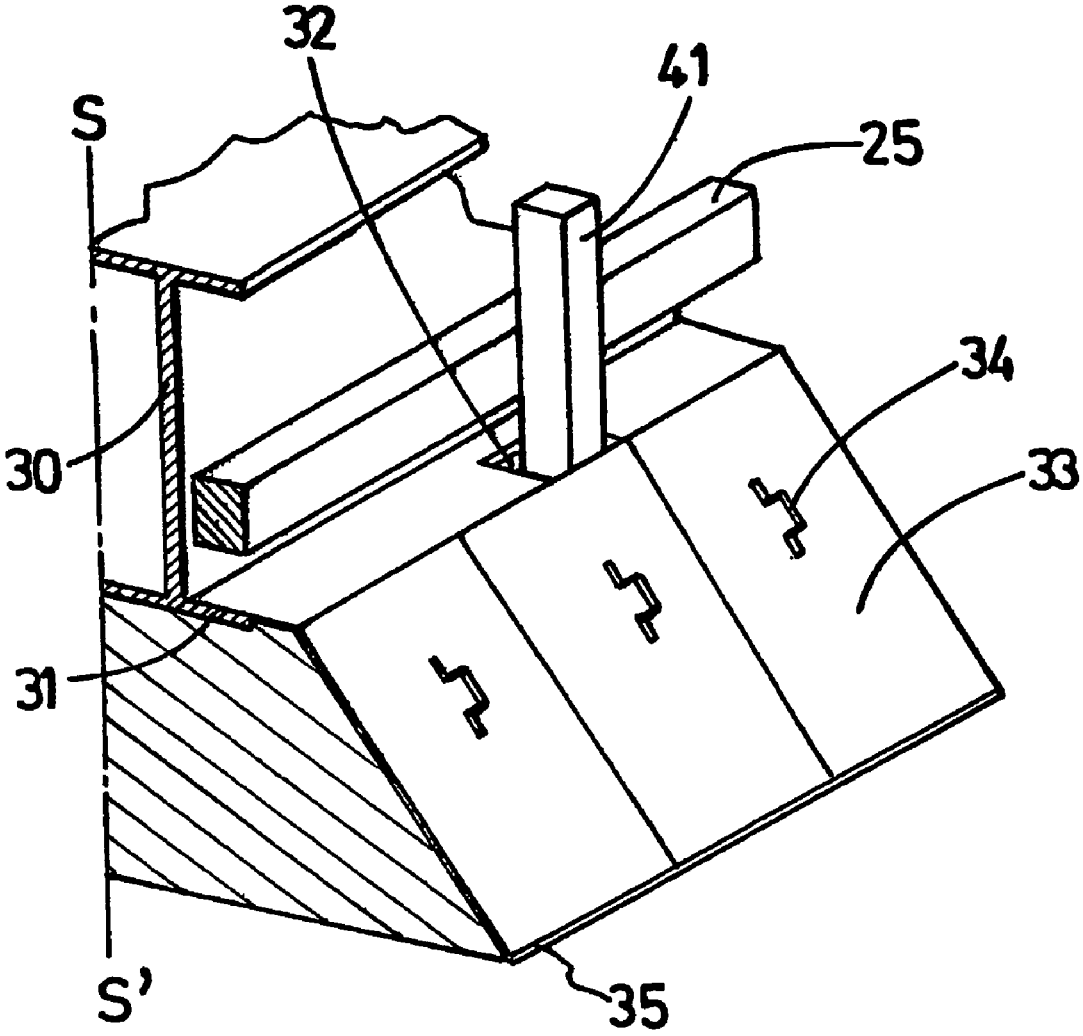
FIG. 3 shows a perspective view of part of the electrolytic cell in FIG. 2.
Figure 4:
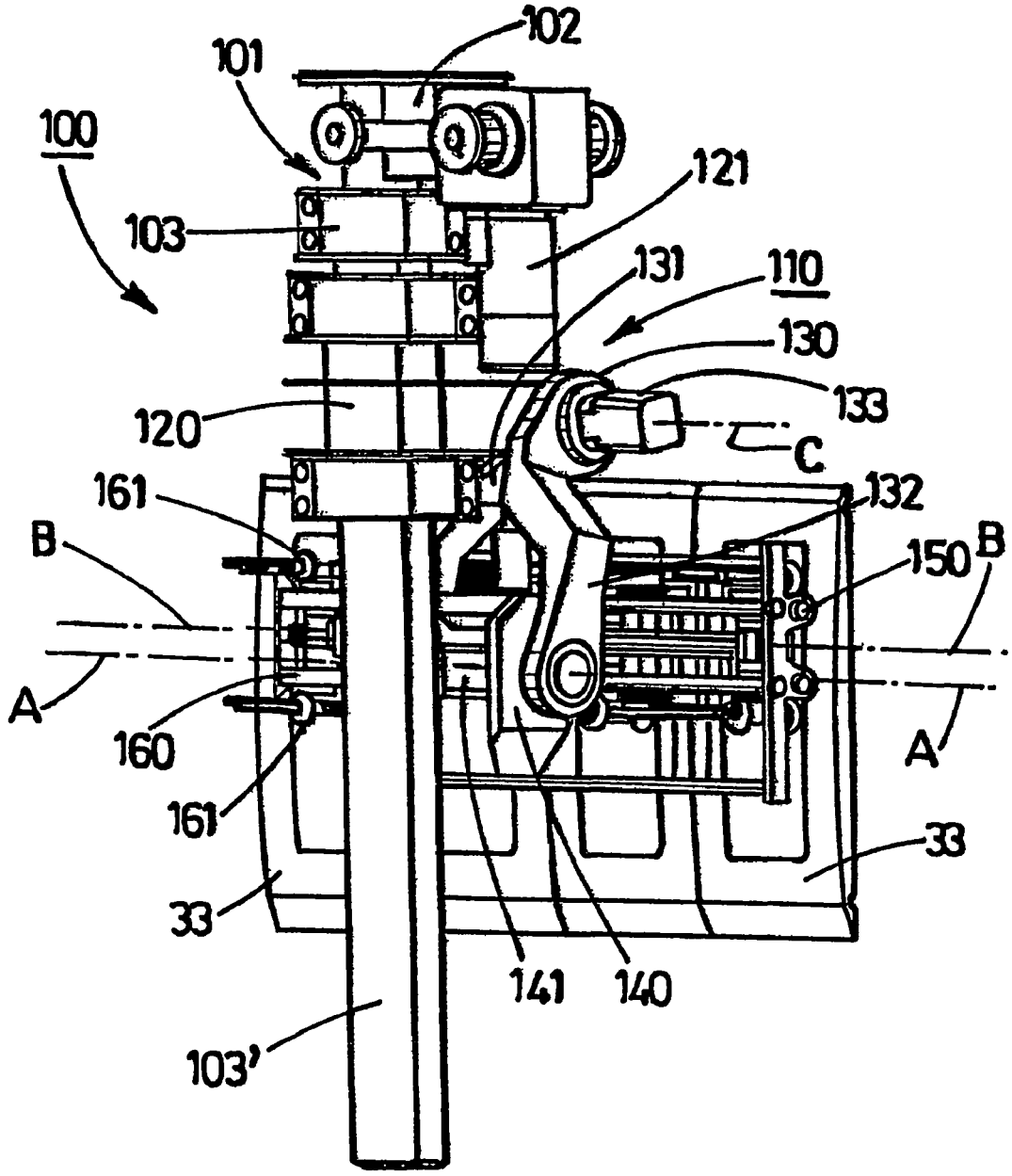
FIG. 4 shows a hood-handling device according to a preferred embodiment of the invention.
Figure 5A:
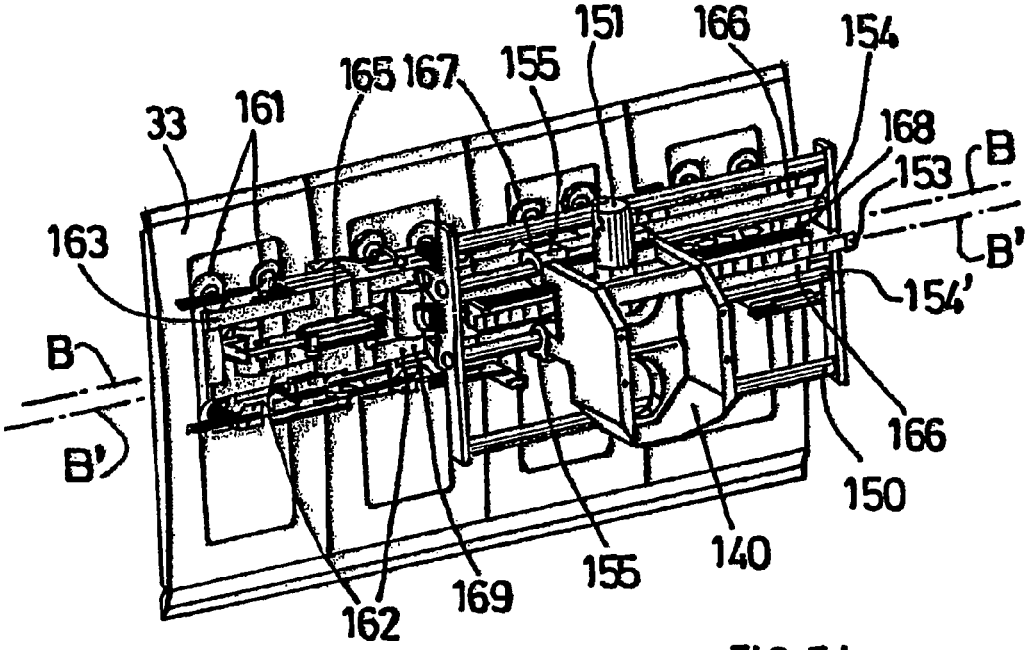
FIGS. 5A and 5B show two different viewing angles of a part of the hood-handling device shown in FIG. 4.
Figure 5B:
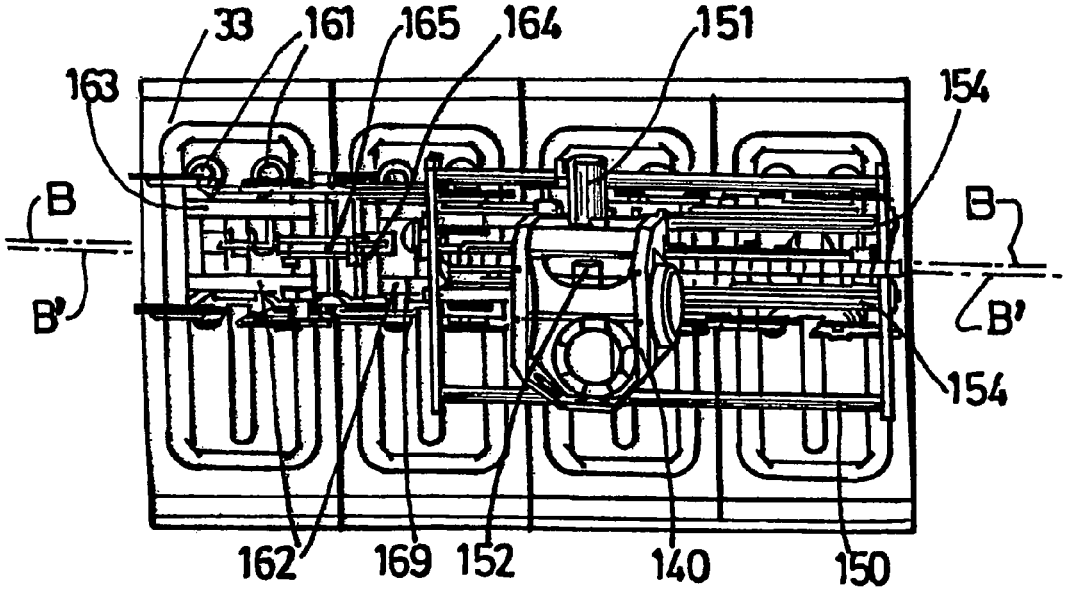

The electrolytic cell (2) is provided with a hood system shown in FIGS. 2 and 3. The hood system comprises a series or removable hoods (33) that are typically metallic and more typically made of an aluminium alloy. The hood system confines effluents inside (29) the cell and is connected to means (not shown) of evacuating the effluents and directing them towards a treatment centre. The removable hoods (33) are typically inserted into a guide groove (35) formed along the cell and laid to an edge (31) of the superstructure. The hoods (33) are generally provided with a handle (34) intended for handling by operators. The anodes stems (41, 41') typically emerge from the hood system through openings (32) formed for this purpose in the hood system.

According to the most widespread technology, the anodes (40, 40') are made of a prebaked carbonaceous material. Progressive consumption of anodes during electrolytic reduction reactions of aluminium requires work on electrolytic cells, particularly including the replacement of spent anodes (40') by new anodes (40).

The pot tending assembly (4) is used to perform operations on electrolytic cells (2) such as anode changes or filling hoppers for supplying electrolytic cells with crushed bath and $AlF_3$. It can also be used for handling various loads such as pot elements, liquid metal ladles or anodes.

As shown in FIG. 1, the pot tending assembly (4) comprises a travelling crane (5) that can move above the electrolytic cells (2) and a tending machine (6). The tending machine (6) comprises a mobile trolley (7) and a tending module (8) provided with several handling and tending devices (10) such as tools (shovels, wrenches, crust breakers, etc.). The travelling crane (5) is supported on and runs along running tracks (9,9') parallel to each other and to the main axis of the hall (and the row or cells). The travelling crane (5) can thus move along the electrolysis room (1). The mobile trolley (7) may be moved along the travelling crane (5).

The tending machines (6) used for anode changing operations are equipped with a determined set of tools (10) typically a crust breaker, a bucket shovel, an anode gripping device (called "anode grab") and a hopper provided with a retractable duct. The crust breaker breaks the alumina crust and the solidified bath that usually hoods all or part of anodes in the cell; the bucket shovel is used to clear the anode position after the spent anode has been removed, by removing solid materials (such as pieces of crust and alumina) in this location; the anode grab is used to grip and handle anodes by their stem, particularly to remove spent anodes from an electrolytic cell and to put new anodes into place in the electrolytic cell; the retractable duct is used to add alumina and/or crushed bath into the electrolytic cell, so as to make a coating layer after a new anode has been put into place. The crust breaker, the bucket shovel and the anode grab are typically mounted on the lower end of a guide device such as a mast or a telescopic arm.

Replacement of a spent anode (40') by a new anode (40) requires prior removal of a determined number of hoods (33) close to the spent anode (40'), temporary storage and putting them back into place at the end of the anode replacement operations.

According to the invention, hoods are handled using a handling device (100) that comprises a positioning device (110) and a hood-gripping system (160).

In one preferred embodiment of the invention, the positioning device (110) includes:

- a vertical guide device (101);
- a mobile support (120) such as a trolley, mounted on the guide device (101) so that it can be displaced during use at least along a vertical direction;
- an articulated arm (130) mounted on the mobile support (120);
- a first framework (140) mounted on the articulated arm (130) so that it can pivot about a first substantially horizontal rotation axis A during use;
- a motor (141) to pivot the first framework (140) around the said first rotation axis A;
- a second framework (150) mounted on a first framework (140) so that it can be moved along a first determined translation axis B, that is substantially horizontal during use (and typically parallel to the A axis);
- means (151, 152, 153, 154, 155) of displacing the second framework (150) along the said first translation axis B.

The vertical guide device (101) typically comprises one fixed element (102) and at least one mobile element (103, 103') and the mobile support (120) is mounted on the mobile element or one of the mobile elements (103, 1031). The vertical guide device (101) is typically chosen from among telescopic masts. In the embodiment shown in FIGS. 4 to 8, the vertical guide device (101) is a telescopic mast comprising a fixed shaft (102), a first sliding shaft (103) and a second sliding shaft (103') and the mobile support (120) is mounted on the second sliding shaft (103'). The mobile support (120) is typically moved by a motor (121).

The articulated arm (130) is used to displace the hoods in a direction substantially perpendicular to the long sides of the electrolytic cells. The first framework (140) is used to adjust the inclination of the hoods (33) with respect to the electrolytic cell (2). The second framework (150) is used for lateral movement of the hoods (33), in other words along a direction substantially parallel to the long sides of the electrolytic cells. These movements enable precision positioning of the hoods during handling and are performed within a first determined tolerance range typically of the order of ±0.5 cm.

In the example embodiments shown in FIGS. 4 to 8, the articulated arm (130) includes a fixed member (131) fixed to the mobile support (120) and a mobile member (132). A first end of the mobile member (132) is fixed to the fixed member (131) so that it can pivot about a second axis C that is substantially horizontal during use, using a motor (133). A second end of the mobile member (132) is fixed to the first framework (140) and enables this framework to pivot about the said first rotation axis A.

In the examples in FIGS. 4 to 8, the displacement means (151 to 155) of the second framework (150) comprise a motor (151) fixed to the first framework (140) and provided with a gearwheel (152), a rack (153) fixed to the second framework (150) and inside which the gearwheel (152) becomes engaged, guides (154) and bearings (155) installed free to slide on the guides (154).

The gripping system (160) of the hoods includes a determined set of gripping devices (161) that will grip a determined set of hoods (33) at a determined number of attachment points. The hood-gripping system (160) is fixed directly or indirectly to the second framework (150).

Work on electrolytic cells and particularly anode change operations usually require that several hoods should be removed at the same time. The determined set of hoods (33) typically includes at least three hoods (33). FIGS. 4 to 8 illustrate a case in which the device can be used to manipulate four hoods simultaneously.

In order to significantly reduce mechanical oscillations of hoods during handling and thus to achieve high positioning precision, the number of attachment points is preferably greater than or equal to three per hood and the said points are preferably arranged so as to form a plane. The hoods (33) thus remain substantially immobile (and typically parallel) with respect to the second framework (150) during their manipulation.

Gripping devices (161) may be chosen from among any known gripping means, such as hooks or electromagnets. However, the gripping devices (161) are advantageously suction cups activated by a pneumatic system, so that hoods without means complementary to the means in the gripping system (160) can be gripped. In the embodiment shown in FIGS. 4 to 8, the number of suction cups and therefore the number of attachment points is four per hood, which increases the reliability of the device. Advantageously, the gripping system (160) also includes blower means that will clean the said attachment points on the hood(s) by blowing, before the said suction cups are activated.

Figure 6A:
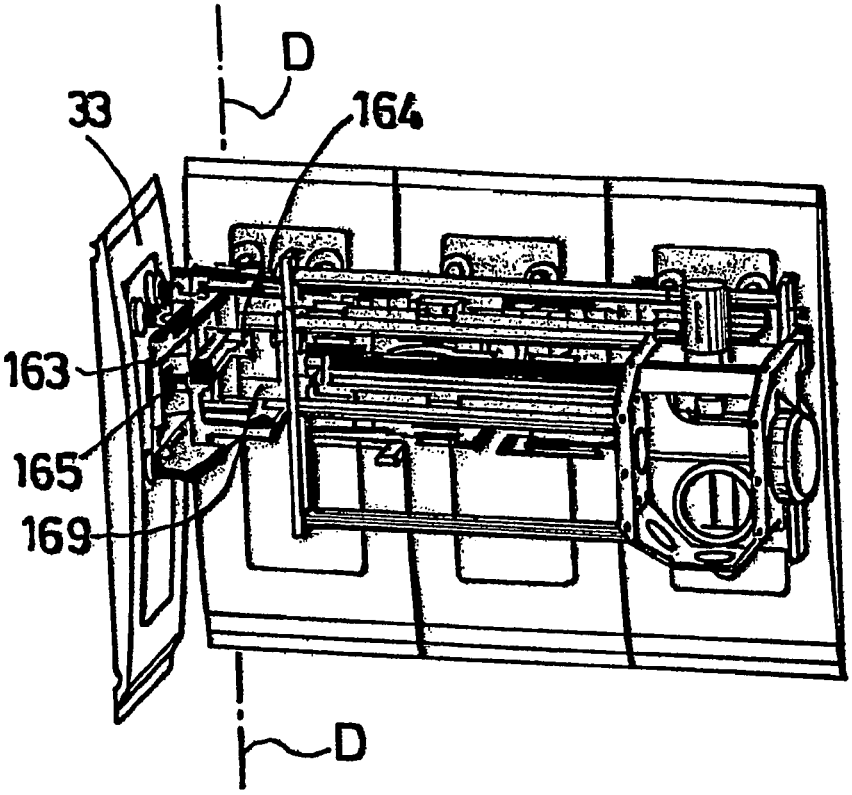
FIGS. 6A and 6B show operation of the hood-handling device according to the invention, in the variant that includes an articulated framework.
Figure 6B:
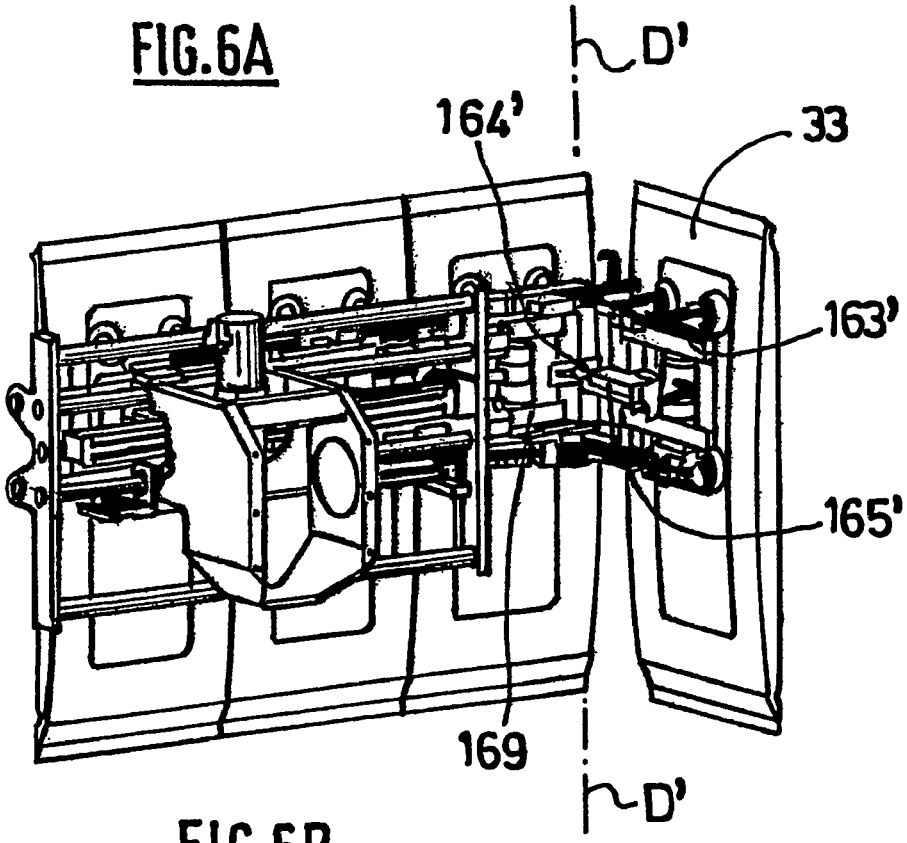

The gripping system (160) advantageously comprises an articulated framework (162) comprising a fixed frame (169) fixed to the second framework (150), at least one articulated frame (163, 163') fixed to the fixed frame (169) by at least one hinge (164, 164') so that it can pivot around an axis (D, D') that is substantially vertical during use, and for each articulated frame (163, 163'), an actuator (165, 165') designed to make the or each articulated frame (163, 163') pivot about the said axis. The said actuator (165, 165') is typically a jack. This variant of the invention is particularly advantageous when the electrolytic cells have positive risers (52) at close spacings. For these cells, the width covered by the determined set of hoods is usually greater than the distance that separates two adjacent positive risers. In this case, the articulated framework (162) retracts one of the hoods from the assembly, typically placing it perpendicular to the plane of the other hoods as shown in FIGS. 6A and 6B, to reduce the total width of the set of hoods and to pass between the positive risers (52).

The articulated framework (162) preferably comprises two articulated frames (163, 163') arranged so as to form a triptych. More precisely, the articulated framework (162) preferably comprises a first articulated frame (163) fixed to a first end of the fixed frame (169) by at least a first hinge (164), a first actuator (165) designed to make the first articulated frame (163) pivot about a first axis D, a second articulated frame (163') fixed to a second end of the fixed frame (169) by at least one second hinge (164'), and a second actuator (165') designed to make the second articulated frame (163') pivot about a second axis D' using a second actuator (165'). This variant of the invention is used to place either of the end hoods perpendicular to the plane of the other hoods. It is particularly advantageous in cases in which the set of hoods to be handled includes one or more hoods located under the positive risers on one side of the handling device (100). FIGS. 6A and 6B illustrate this variant of the invention.

In order to facilitate clearing sufficient space to enable pivoting of the said frame (163, 163'), the articulated framework (162) is advantageously mounted on the second framework (150) so that it can be moved along a second determined translation axis B' that is substantially horizontal during use and that is typically parallel to the said first determined translation axis B, and the positioning device (110) for the hoods comprises means (166, 167, 168) such as a guided actuator to displace the articulated framework (162) along the second translation axis B', that is typically parallel to the first translation axis B. In the embodiments shown in FIGS. 4 to 8, the said displacement means (166, 167, 168) of the articulated framework (162) comprise guides (166) mounted on the second framework (150), bearings (167) fixed to the articulated framework (162) and mounted on the guides so that they can slide along them, and a linear actuator (168) such as a rod-less jack. These means are sufficient to displace the articulated framework (162) between two end positions.

Figure 7:
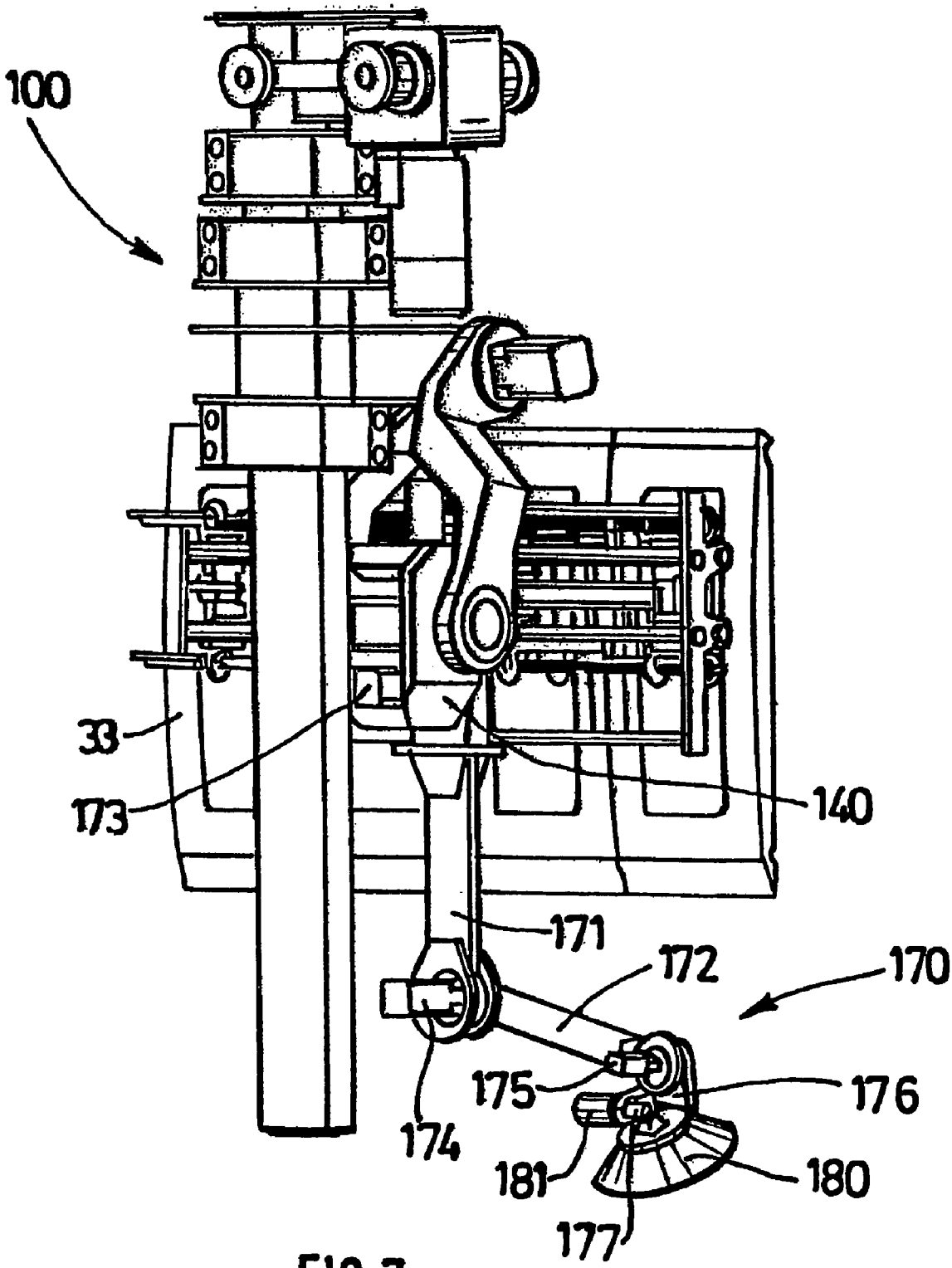
FIGS. 7 and 8 show embodiments of an advantageous variant of the hood-handling device according to the invention.
Figure 8:
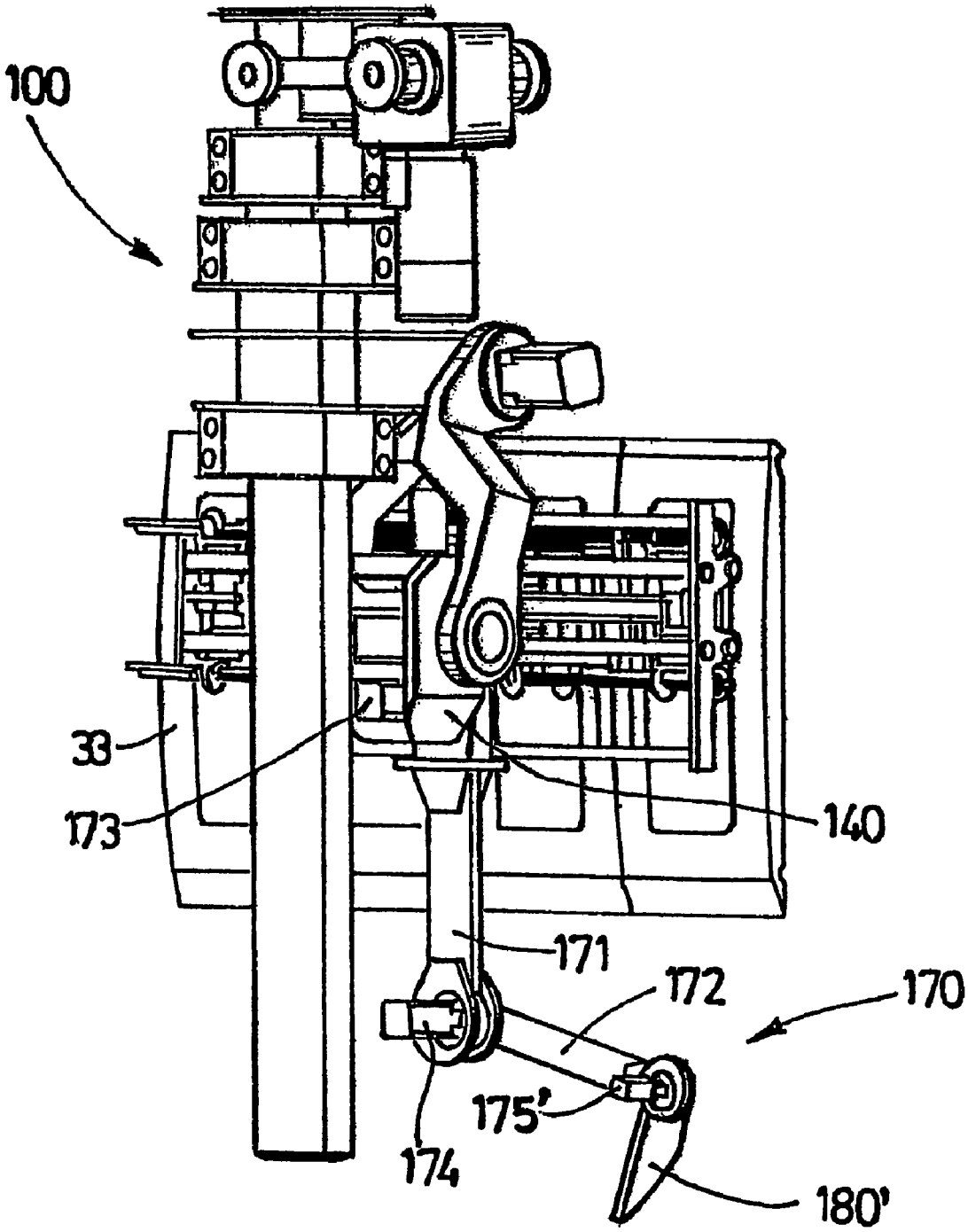
Figure 9:
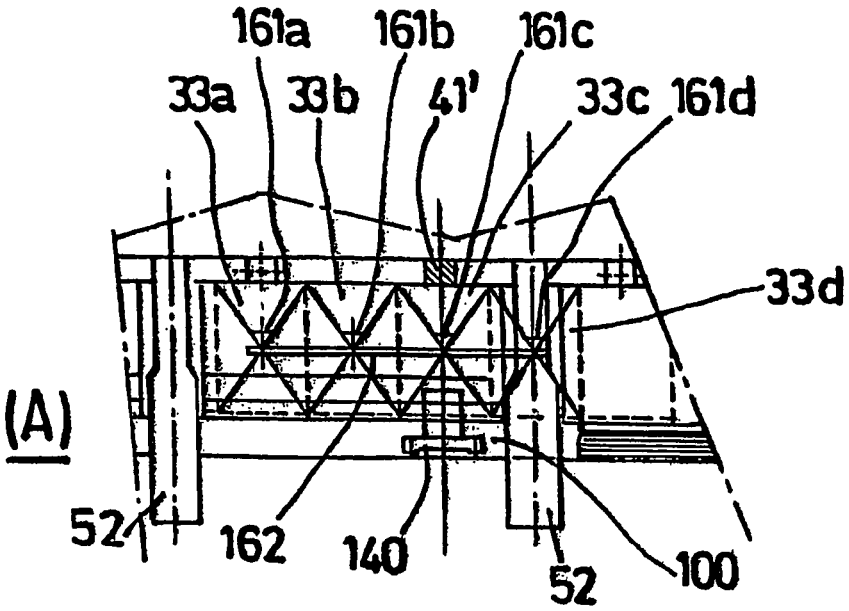
FIGS. 9 to 15 show operation of the hood-handling device according to the invention.
Figure 9:
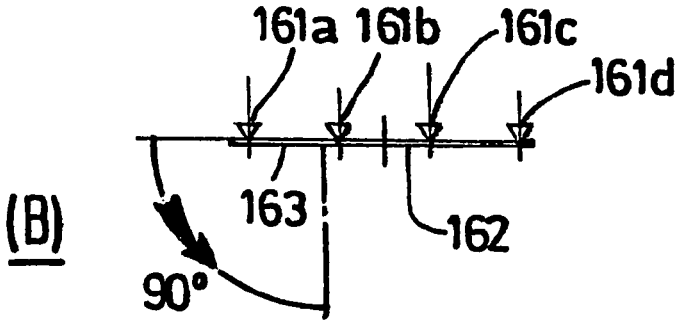
Figure 9:
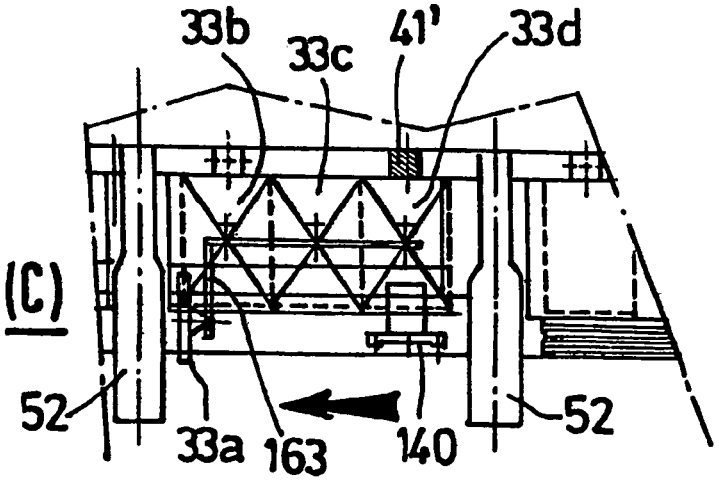

FIG. 9 illustrates an example operation of this variant of the invention in the embodiment shown in FIGS. 4 to 8 in which the handling device (100) is used to manipulate four hoods (33*a*, 33*b*, 33*c*, 33*d*) simultaneously. The electrolytic cell is shown partially in a top view. In this example, three hoods (33*a*, 33*b*, 33*c*) are located between two successive positive risers (52, 52') and the fourth hood (33*d*) is located under one of the two positive risers (52'). The anode to be changed, for which the stem (41') is shown in section, is located behind the third hood (33*c*) starting from the left. The articulated framework (162), the gripping devices (161*a*, 161*b*, 161*c*, 161*d*) and the first framework (140) are shown diagrammatically. As shown in FIG. 9(A), the handling device (100) is initially placed such that the first framework (140) is facing the anode to be changed and the gripping devices (161*a*, 161*b*, 161*c*, 161*d*) are facing each of the corresponding hoods (typically close to the vertical axis of each hood). The articulated framework (162) is then partially underneath the right positive riser (52'). The gripping devices (161*a*, 161*b*, 161*c*, 161*d*) are applied on the hoods and are activated so as to grip them. The hoods are then released from their position and slightly lifted. The first hood (33*a*) is retracted, typically by pivoting the left articulated frame (163) by 90° with respect to the plane of the other hoods (as shown in FIG. 9(B)). As shown in FIG. 9(C), the articulated framework (162) is offset towards the left, so that the handling device can remove all hoods without being hindered by the positive risers (52, 52').

In one advantageous variant of the invention, the hood-handling device (100) also comprises a cleaning means (180, 180') mounted on a second articulated arm (170). The cleaning means (180, 180') is used particularly to remove dust and crust and anode debris left by anode changing operations, particularly in the guide grooves (35) before the hoods are put back into place. The cleaning means (180, 180') is typically chosen from among brushes, scrapers and/or blowing means. FIGS. 7 and 8 illustrate embodiments of this variant in which the second articulated arm (170) is mounted on the first framework (140). In these examples, the articulated arm (170) comprises a first (171) and a second (172) mobile member connected to each other through an articulation point, the first mobile member (171) is fixed on the first framework (140) so that it can pivot about a first articulation axis that is typically horizontal during use, using a first motor (173), the articulated arm (170) comprises a second motor (174) to make the second mobile member (172) pivot about a second articulation axis passing through the articulation point, and the cleaning means (180, 1801) is fixed to the second mobile member (172). In the example in FIG. 7, the cleaning means (180) is a brush that is fixed to the second mobile member (172) by a lever (176) so that it can pivot about a third articulation axis using a third motor (175), possibly coupled through a reduction gear (177). The brush (180) is typically a rotating brush activated by a motor (181). In the example in FIG. 8, the cleaning means (180') is a scraper activated by a third motor (175'). The second articulated arm (170) may possibly be mounted on a distinct handling device (100).

The hood-handling device (100) according to the invention may include hood-locking means onto the gripping system (160) as a complementary safety attachment means if there is an operating fault in the gripping devices. Preferably, the locking means are mechanical means to assure reliable locking. For example, the locking means may comprise a hook mounted on a rotary jack and capable of being inserted in the handles (34) of the hood (33).

The handling device (100) according to the invention may be equipped with a computerised control system, so as to enable automated handling of the hoods (33). This control system may perform pre-programmed operations and/or execute automatic control programs. To achieve this, the hood-handling device (100) advantageously comprises an encoder and a detection system capable of detecting the presence of hoods, and their orientation and position. This variant of the invention efficiently locates the hoods which, although in principle are placed in determined locations, may be moved with respect to their theoretical position, although usually within a determined tolerance range. Signals about the presence of the said hoods, their orientation and position are transmitted to the said encoder that transforms them into numeric data for the control system. The detection system typically comprises at least one remote measurement system such as a laser telemeter. For example, the detection system may comprise a set of two telemeters configured so as to detect the presence of a determined hood by reflection and measure the orientation and position of this hood. The detection system may advantageously be used to detect the presence of determined surface patterns and/or elements on the hood so as to avoid or impose placing the gripping devices (161) on these elements or patterns. For example, when the hoods are provided one with one or several handles and stiffeners, the detection system can be used to detect the position of the handles that are usually significantly raised with respect to the hoods and consequently easier to differentiate from the hoods, and the position of the handles can be used as markers for positioning the gripping devices (161) with respect to the hoods.

The handling device (100) according to the invention advantageously comprises a remote measurement system configured to measure the distance between at least one determined point on the handling device (100) and a point on an electrolytic cell, so as to control this distance. The reference point determined on the cell is typically located on the anode beam, the anode stems or hoods. The remote measurement system is advantageously chosen from among telemeters (typically laser telemeters), spatial configuration analysers and cameras provided with an image analyser. This variant of the invention can for example verify the distance between gripping devices (161) and determined points on an electrolytic cell, and therefore the distance between the gripped hoods and the said points so as to very precisely position the hoods with respect to the cell.

The hood-handling device (100) according to the invention is designed to be mounted on a transport device such as a pot tending assembly (4), a tending machine (6) or a self-powered vehicle capable of moving along the circulation aisle (3) and in the access paths (3'). A hood-handling device (100) may thus be used for several distinct cells. The transport device will be used for work on electrolytic cells (2) for the production of aluminium. In order to simplify the task of operators, the hood handing device (100) according to the invention is advantageously mounted on a pot tending assembly (4) or a tending machine (6) designed for anode change operations, possibly on the same tending machine (6) that includes the said determined set of tools (10).

The transport device is used to put the positioning device (110) into place close to the hood or the set of hoods (33) to be handled. This relatively coarse approach is made within a second determined tolerance range typically of the order of ±1 cm.

A spent anode (40') is typically replaced by a new anode (40) following a procedure in which:

- a tending machine (6) comprising the said determined set of tools (10) is placed close to the determined spent anode (40');
- a determined number of hoods (33) located close to the spent anode (40') are removed and they are stored close to their original location, usually putting them down on adjacent hoods;
- the metallic stem (41') of the spent anode (40') is gripped using an anode grab;
- the connector (26') of the spent anode is loosened and is removed using a connector handling tool that may be mounted on the tending assembly used for anode changes;
- the spent anode (401) is removed from the electrolytic cell using an anode grip and it is put down at a determined location;
- a replacement anode (40) is gripped using a handling tool, usually the same anode grab that was used to handle the spent anode, and it is placed in the position initially occupied by the spent anode;
- the replacement anode (40) is fixed on the anode beam (25) using a connector (26);
- the hoods (33) are put back into place into their original position.

Hoods may be handled using the hood-handling device (100) according to the invention. Handling typically includes the following operations:

- The transport device provided with a handling device (100) is put into position close to the spent anode (40') that will be changed, typically with reference to its metallic stem (41'). This manoeuvre, which may be automated if the device is provided with a computerised control system, is intended to put the positioning device (110) into a determined position with respect to the hoods to be removed with a determined precision of the order of ±2 cm, and preferably ±1 cm. This position forms a reference point for subsequent movements of the members of the handling device (100).
- The vertical guide device (101) and/or the mobile support (120) are activated so as to put the mobile support (120) into place at a determined height with respect to the level of the access path (3').
- The articulated arm (130), the first framework (140), the second framework (150) and optionally the gripping system (160) are manoeuvred so as to put the gripping devices (161) of the gripping system (160) into position to grip the said hoods.
- The gripping devices (161) are activated so as to grip the determined hoods (four in FIGS. 4 to 8).
- The articulated arm (130), the first framework (140), the second framework (150) and optionally the gripping system (160) are manoeuvred, so as to remove the said hoods and transport them to a determined storage area. The determined storage area is advantageously set back from the work area necessary for anode change operations. The hoods preferably remain fixed to the gripping devices (161) throughout all anode change operations and until they are put back into place, to achieve the precision necessary for putting the hoods back into place after the anode has been changed.

After the anode change operations, the articulated arm (130), the first framework (140), the second framework (150) and optionally the gripping system (160) are manoeuvred so as to put the said hoods back into their initial position. Before replacing the hoods, it is usually preferable to remove dust and crust and anode debris left following anode change operations. This cleaning may be done manually or using the said cleaning means (180, 180'). The use of the cleaning means (180, 180') according to the invention enables extensive automation of hood handling.

When gripping hoods, it is advantageous to check that the gripping devices (161) actually get a good grip on the hoods. This check may be done automatically using complementary measurement means and/or the gripping device activation system. For example, gripping of hoods can be checked using a detection system capable of detecting the presence of hoods and/or, in the variant of the invention in which these devices are provided with suction cups, using a measurement of the pressure in the pneumatic system. For safety reasons, displacement of the hoods can be prohibited if a hood is not gripped by a minimum number of gripping devices (161); for example, if the gripping system (160) comprises four gripping devices per hood, displacement could be prohibited if a hood is not gripped by at least three of these devices. An operator can then take action to verify the cause of the failure.

Hood displacement manoeuvres during their removal, storage or replacement, are carried out so as not to touch the positive risers and the hoods that have not been removed. Movements of the second framework (150) are usually necessary when at least one of the hoods of the set is located between a positive riser (52) and the pot (20). In this case, manoeuvres typically include positioning of the said set of hoods at a determined distance from the plane of the hoods left on the cell, so as to put them at a sufficient distance so that they do not catch the handles of hoods left on the cell, and lateral displacement of the set of hoods.

Advantageously, a substantially horizontal and low amplitude oscillation movement (typically less than about 10 mm, and more typically between 1 and 10 mm) of the hoods can be generated when the hoods are removed, by creating a corresponding movement in the second framework (150). In particular, the purpose of this movement is to facilitate extraction of the hoods when they are gripped by adjacent hoods or put into position when the space left by the hoods already in position on the electrolytic cell is insufficient.

In the variant of the gripping system (160) comprising displacement means (166, 167, 168) of the articulated framework (162), the manoeuvre of the gripping system (160) may include lateral displacements of the articulated framework (162) by actuation of displacement means (166, 167, 168), in addition to the movement of the frame(s) (163). These lateral displacements are usually required when the width covered by the set of hoods fixed to the gripping system (160) is greater than the distance separating two adjacent positive risers. In this case, the frame or one of the frames (163) is put into position perpendicular to the plane of the other hoods using the actuator (165, 165'), which reduces the total width of the set of hoods, and the articulated framework (162) is moved towards the said frame using displacement means (166, 167, 168) so as to put the set of hoods into a position in which they can be slid between two adjacent positive risers without them getting caught.

In the variant of the handling device (100) including a detection system, the hood-handling operations advantageously include a measurement of the position and orientation of the hoods that will be gripped by the device. These measurements improve the precision with which manoeuvres for positioning the input of the gripping system (160) can be performed. These measurements also enable precise replacement of the hoods after anode change operations. These measurements also enable full automation of the manoeuvres.

Figure 11:
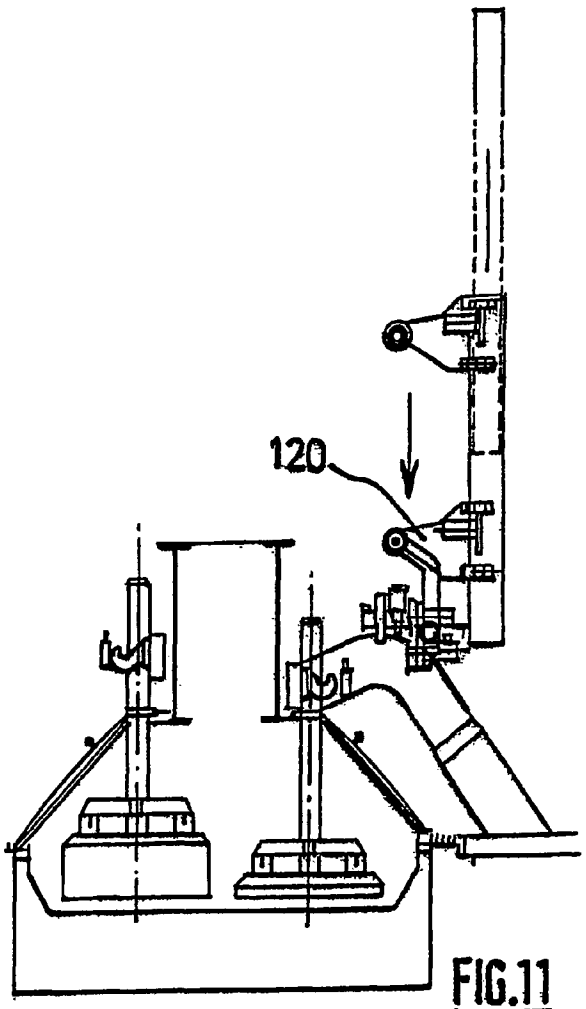
Figure 10:
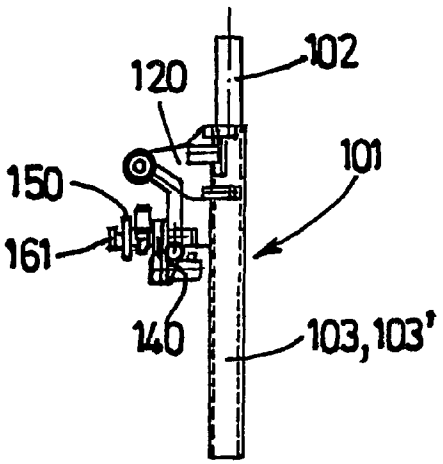
Figure 10:
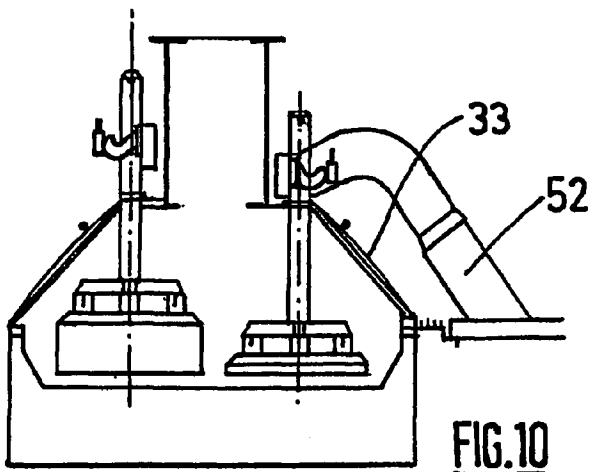
Figure 13:
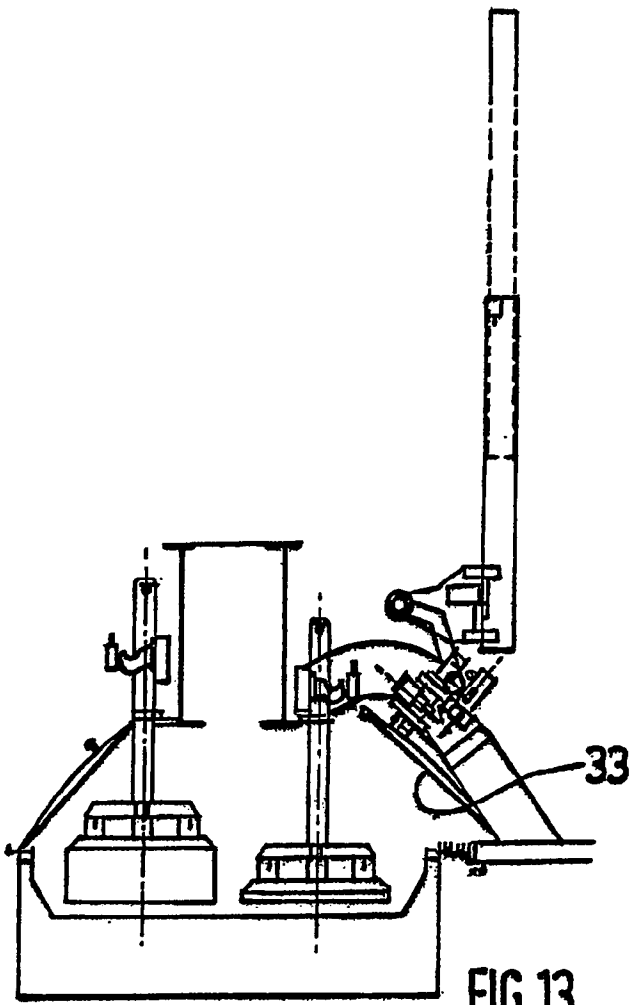
Figure 12:
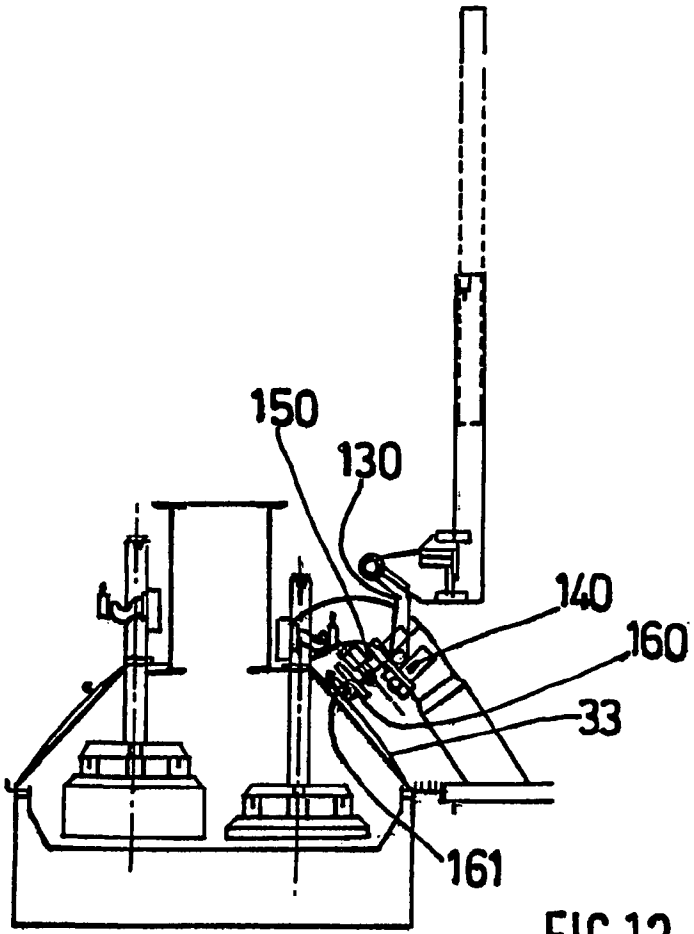
Figure 15:
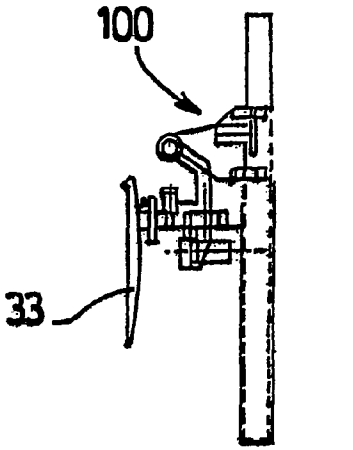
Figure 15:
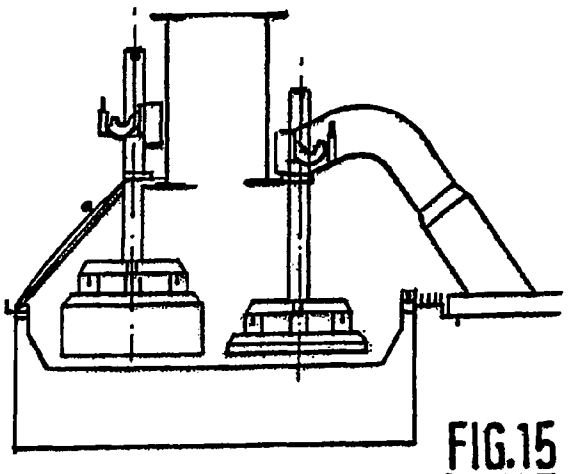
Figure 14:
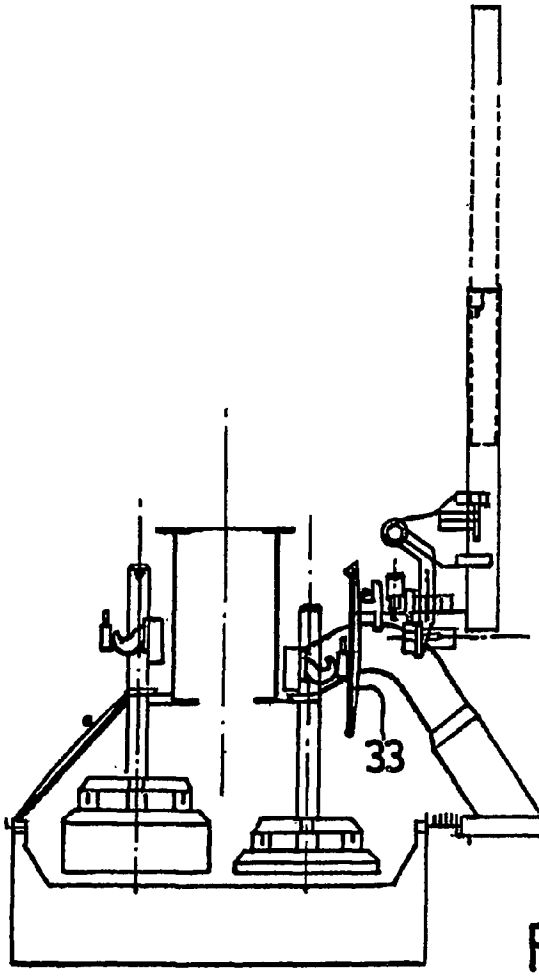

As shown in FIGS. 10 to 12, hoods may be handled by a process in which:

- the handling device (100) is put into an initial position (FIG. 10);
- the mobile support (120) is lowered (FIG. 11);
- the gripping devices (161) are put into a hood (33) gripping position by moving the gripping system (160) using the articulated arm (130) of the first framework (140) and the second framework (150) (FIG. 12);
- the hoods (33) are released from their position and are lifted up to a determined position (FIG. 13);
- the hoods (33) may be moved laterally and optionally one or several hoods are retracted as shown in FIG. 9, so as to enable complete removal of the set of hoods gripped by the handling device (100);
- the hoods (33) are put into a determined position (FIG. 14);
- the hoods (33) are removed from the work area on the cell and the handling device (100) is put into a determined waiting position which is preferably sufficiently far from the cell so that is does not hinder actual anode change operations (FIG. 15).

The hoods (33) may be put back into place using a similar method, using the same operations in the reverse order.

The invention claimed is:

1. Handling device for hoods of a cell for the production of aluminium by fused bath electrolysis, comprising:

a positioning device that comprises a vertical guide device, a mobile support mounted on the vertical guide device so that it can be moved in at least a vertical direction during use, an articulated arm mounted on the mobile support, a first framework mounted on the articulated arm so that it can pivot about a first rotation axis A substantially horizontal during use, the said articulated arm being at least capable of moving the first framework away from or towards the mobile support, a motor to make the first framework pivot about the said first rotation axis A, a second framework mounted on the first framework so that it can be moved along the first determined translation axis B, that is substantially horizontal during use, and means of displacing the second framework along the said first translation axis B;

a hood-gripping system fixed to the second framework and including a determined set of gripping devices designed to grip a determined set of hoods at a determined number of attachment points.

2. Handling device according to claim 1, wherein the vertical guide device comprises one fixed element and at least one mobile element, and in that the mobile support is mounted on the or one of the mobile elements.

3. Handling device (100) according to claim 2, wherein the vertical guide device is chosen from among telescopic masts.

4. Handling device (100) according to claim 1, wherein the displacement means of the second framework comprise a motor fixed to the first framework and provided with a gearwheel, a rack fixed to the second framework and inside which the gearwheel becomes engaged, guides and bearings installed free to slide on the guides.

5. Handling device according to claim 1, wherein the number of attachment points is greater than or equal to three per hood and in that the said points are preferably arranged so as to form a plane.

6. Handling device according to claim 1, wherein the gripping devices are suction cups activated by a pneumatic system.

7. Handling device according to claim 6, wherein gripping system also includes blower means that will clean the said attachment points on the hood(s) by blowing, before the said suction cups are activated.

8. Handling device according to claim 1, wherein the gripping system comprises an articulated framework comprising a fixed frame fixed to the second framework, at least one articulated frame fixed to the fixed frame by at least one hinge so that it can pivot about an axis (D, D') that is substantially vertical during use, and for each articulated frame, an actuator designed to make the or each articulated frame pivot about the said axis.

9. Handling device according to claim 8, wherein the articulated framework comprises two articulated frames arranged so as to form a triptych.

10. Handling device according claim 8, wherein the articulated framework is mounted on the second framework so that it can be moved along a second determined translation axis B' that is substantially horizontal during use, and that is typically parallel to the said first determined translation axis B, and in that the positioning device for the hoods comprises means of displacing the articulated framework along the second translation axis B'.

11. Handling device according to claim 10, wherein the said displacement means of the articulated framework comprise a guided actuator.

12. Handling device according to claim 10, wherein the said displacement means of the articulated framework comprise guides mounted on the second framework, bearings fixed to the articulated framework and mounted on the guides so that they can slide along them, and an actuator.

13. Handling device according claim 1, further comprising a cleaning means mounted on a second articulated arm.

14. Handling device according to claim 13, wherein the cleaning means is chosen from among brushes, scrapers and/or blowing means.

15. Handling device according to claim 1, further comprising a computerised control system.

16. Handling device according to claim 15, further comprising an encoder and a detection system capable of detecting the presence of hoods, their orientation, their position and/or the presence of determined surface patterns and/or elements on the hoods.

17. Handling device according to claim 16, wherein the detection system comprises at least one remote measurement system.

18. Handling device according to claim 17, wherein the remote measurement system is a laser telemeter.

19. Handling device according to claim 1, further comprising a remote measurement system configured so as to measure the distance between at least one determined point on the handling device and one point on the electrolytic cell.

20. Handling device according to claim 19, wherein the remote measurement system is chosen from among telemeters, spatial configuration analysers and cameras provided with an image analyser.

21. Tending assembly for a series of aluminium production cells by fused bath electrolysis comprising a plurality of hoods, comprising at least one hood-handling device according to claim 1.

22. Mobile unit capable of moving in the potroom of a plant for the production of aluminium by fused bath electrolysis, comprising at least one hood-handling device according to claim 1.

23. Mobile unit according to claim 22, further comprising a control system for assuring that said positioning device is located in a determined position with respect to the hood or to the plurality of hoods to be handled, said determined position possibly being defined by a distance DX along the X direction of the long side of the electrolytic cell, a distance DY along the Y direction of the small side of the electrolytic cell and a difference in elevation DZ between a characteristic point on the handling device and a characteristic point on the plurality of hoods to be handled.

24. Mobile unit according to claim 22, provided with an actuator that is used to place said positioning device such that the translation axis B of the second frame is approximately parallel to the X direction along the long side of the electrolytic cell.

25. Mobile unit according to claim 22, which is a self-powered vehicle capable of moving in an approximately horizontal plane and in that optionally, it is provided with an actuator that moves said positioning device along the vertical direction.

26. Mobile unit according to claim 22, which is a tending assembly in a plant for the production of aluminium by fused bath electrolysis comprising a travelling crane and at least one tending assembly.

27. Mobile unit according to claim 26, wherein said travelling crane moves along the Y direction of the small side of the electrolytic cell and in that said tending machine is fixed on a trolley moving along the X direction of the long side of the electrolytic cell.

* * * * *